United States Patent [19]

Bitsch

[11] Patent Number: 4,518,202

[45] Date of Patent: May 21, 1985

[54] SEATING PIECE OF FURNITURE

[76] Inventor: Hans-Ulrich Bitsch, Schanzenstr. 1, 4000 Düsseldorf 11, Fed. Rep. of Germany

[21] Appl. No.: 430,043

[22] Filed: Sep. 30, 1982

[30] Foreign Application Priority Data

Mar. 23, 1982 [DE] Fed. Rep. of Germany ..... 3210525

[51] Int. Cl.[3] ..... A47C 7/02

[52] U.S. Cl. ..... 297/452; 297/445; 248/628; 267/160

[58] Field of Search ..... 297/445, 452; 248/619, 248/628, 626; 267/158, 160, 164

[56] References Cited

U.S. PATENT DOCUMENTS

| | | | |
|---|---|---|---|
| 317,271 | 5/1885 | Adams | 248/628 |
| 2,731,076 | 1/1956 | Rowland | 297/452 |
| 3,225,431 | 12/1965 | Woodard | 297/445 |
| 3,408,061 | 10/1968 | Meyer | 267/160 |
| 3,968,964 | 7/1976 | Grosser et al. | 267/160 |
| 4,304,436 | 12/1981 | Rowland | 297/445 |
| 4,318,556 | 3/1982 | Rowland | 297/445 |

FOREIGN PATENT DOCUMENTS

| | | | |
|---|---|---|---|
| 2647168 | 4/1978 | Fed. Rep. of Germany | 297/452 |
| 1034202 | 7/1953 | France | 297/445 |
| 649458 | 11/1962 | Italy | 297/445 |
| 44503 | 9/1918 | Sweden | 267/160 |
| 454033 | 9/1936 | United Kingdom | 248/628 |

*Primary Examiner*—Francis K. Zugel
*Assistant Examiner*—Mark W. Binder
*Attorney, Agent, or Firm*—Becker & Becker

[57] ABSTRACT

The frame for the seating surface is constructed elastically deformable under load for the purpose of providing a comfortable seating piece of furniture. The seating surface itself is flexible. The frame includes steel tubes, and the seating surface is made of a stainless steel woven mat, which is fastened to the longitudinal frame tubes, while the front and rear transverse pieces of the frame are bent downwardly and inwardly out of the seating plane, so that an elastic deformability is provided under the weight of a seated person without permanent deformation of the stainless steel mat.

15 Claims, 2 Drawing Figures

SEATING PIECE OF FURNITURE

The present invention relates to a seating piece of furniture comprising a frame and a seating surface fastened thereon, especially of non-combustible material.

Seating pieces of furniture, especially chairs, benches, and stools with or without back rests are known in different shapes and designs. The seating comfort is significantly influenced by the material employed for the production of the seat. These materials are either rigid, for instance of wood, or flexible, for instance of leather or fabric, and transmit the loads onto a rigid frame on which in turn the seating legs and, as the case may be, the back rests are fastened. Upholstering is provided to improve the seating characteristics, since the either rigid or only slightly elastic construction of the seats is uncomfortable.

This is especially true for the known iron/cast- and steel-tubular chairs which are employed as garden furniture or industrial seating pieces of furniture. In the special application or employment in hospitals, conference rooms, hotels, airports, and the like, these pieces of furniture are made of non-combustible materials. The safety considerations, for example in hospitals, and the fire protection regulations which are constantly becoming more strict, force the utilization of noncombustible seating pieces of furniture, whereby the known steel-tube chairs or cast chairs must be relied upon, which without seat upholstery and back upholstery have an unacceptable seating comfort over a long period of time. The completely stiff seat fastened in a rigid frame comprises, for example, a wire mesh, of which the linear engagement surfaces with the body of the individual seated thereon lead to considerable pressure stress. If this is avoided, for example by using metal plates as seating surfaces, the unfavorable heat-absorption properties and the poor ventilation represent a feature characteristically reducing the seating comfort. One has to be concerned with undercooling of the body tissue on the one hand, or perspiration on the other hand.

In summary, it is clear that comfortable seating pieces of furniture of non-combustible material were not known prior to applicant's invention.

Accordingly, it is an object of the present invention, in view of this state of the art, to provide seating pieces of furniture which do not burn or are difficult to burn, and which, without additional measures, such as upholstering, provide a good comfort of its own.

Figure 1:
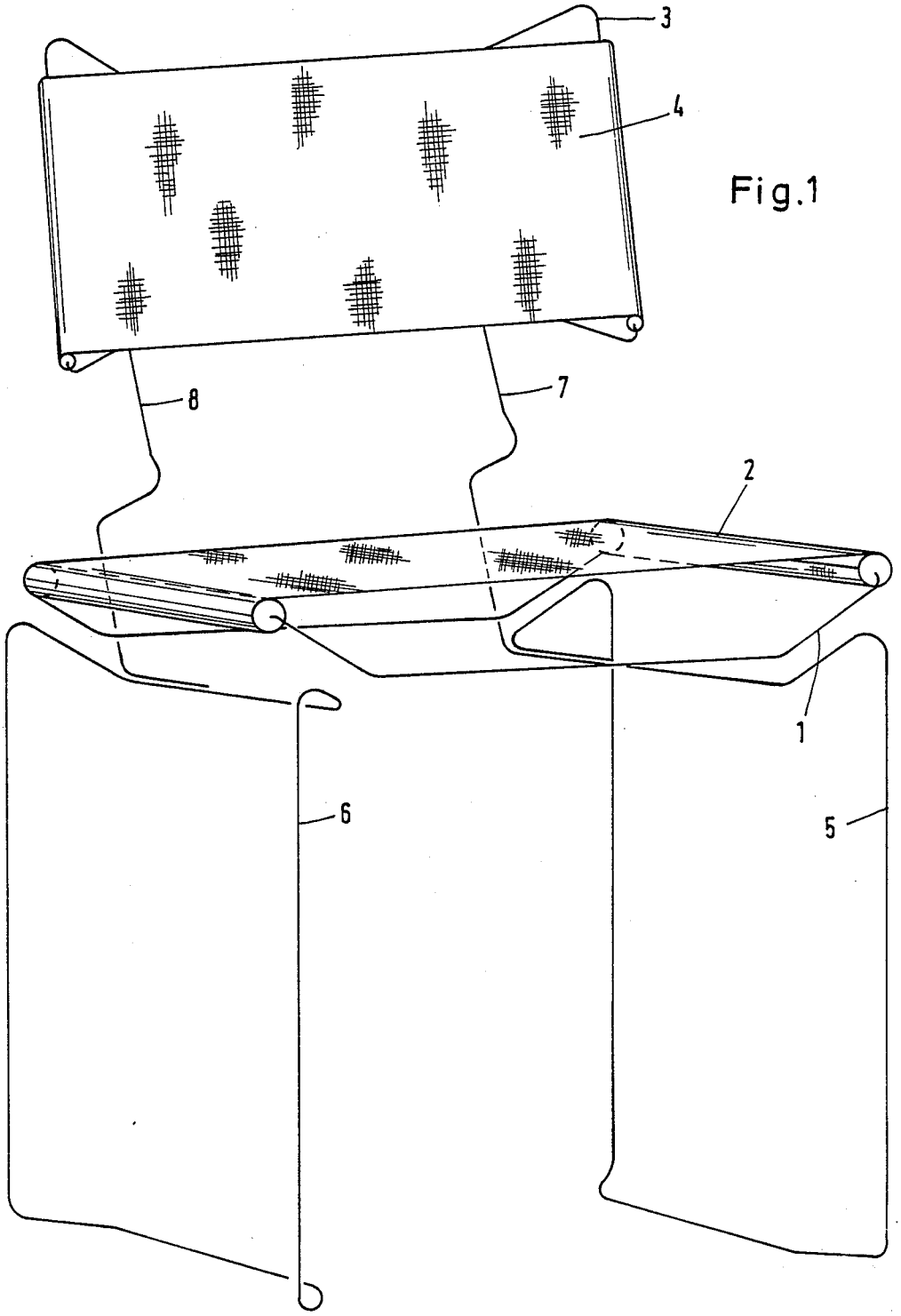
Figure 2:
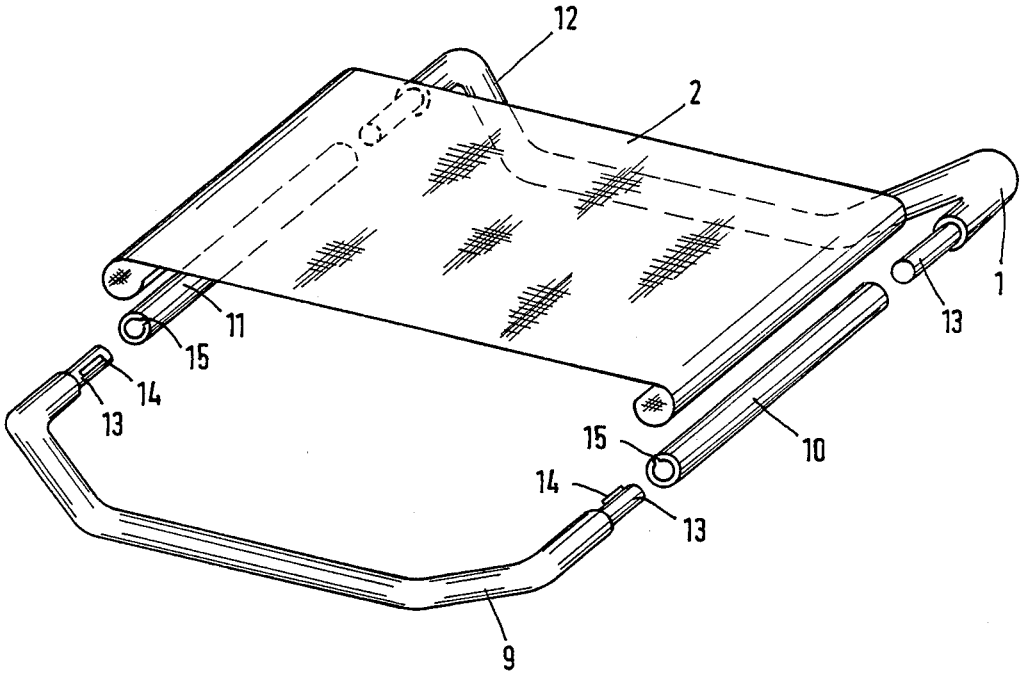

This object, and other objects and advantages of the present invention, will appear more clearly from the following specification in connection with the accompanying drawings, in which:

FIG. 1 is a schematic perspective view of one embodiment of a chair having features according to the present invention; and FIG. 2 is a perspective view of a frame with the seating surface fastened thereon as an essential part of the chair of FIG. 1.

The seating piece of furniture of the present invention is characterized primarily in that the frame is elastically deformable under load, and the seating surface is flexible. Preferably, the elastic deformability of the frame is set in a load-dependent manner in such a way that, with increasing weight, a progressive stiffening of the frame is provided in the sense of an increase of the deformation resistance. For this purpose, the resilience or springiness can be exploited by material selection and shaping in combination with the inherent or self-damping of the frame, or spring elements and/or damping elements, and/or stabilizers of predetermined characteristic, for instance leaf springs and gas-pressure springs, can be provided.

Accordingly, in essence, the object of the present invention basically is to elastically absorb all load or stress by the frame of the seating piece of furniture, and not, as previously, by a rigid or flexible seating surface. The frame, during removal of the load, springs back into its original position, whereby the flexible seating surface is again tensioned or stressed.

Preferably, the frame comprises one or more assembled steel tubes, and a stainless steel woven mat is tensioned as a seating surface between two oppositely located longitudinal tubes. A non-combustible seating piece of furniture of high seating comfort is thus provided in a constructively simple manner. If desired, the steel tubes can be chrome plated. Also, synthetic material parts of corresponding elasticity can be used as frame elements in place of the steel tubes in applications where reduced requirements as to fire resistance exist. According to an expedient specific embodiment of the present invention, this seat or piece of furniture can be further improved in that the stainless steel mat is polished and/or is rolled to flatten or smooth the thread curvature. The polishing procedure can be carried out in a galvanic manner.

A thin, perforated plate of metal or metal foil can be used as an alternative embodiment in place of the woven stainless steel mat for the seating surface, whereby according to the present state of development, however, the stainless steel mat is preferred because of the better fabrication possibility and the better characteristics thereof. Chrome-nickel steel wire thicknesses of between 0.20 and 1.25 mm in combination with a mesh size of 5 to 0.50 mm are set forth as most advantageous strucutural embodiments for the stainless steel mat.

Expediently, the connection of the seating surface with the frame is undertaken accompanied by the application of a prestressing. This can be carried out during the construction of the connection for example by a slight shortening of the seating surface, and elastic deformation of the frame to the dimension of the seating surface, so that the tendency of the frame to occupy a stress-free or tension-free position effects the prestressing or pretensioning of the seating surface. The connection between the frame and the seating surface itself can be produced in any way, especially by welding, adhesion, clamping and/or riveting. It is advantageous to reinforce the seating surface, especially the stainless steel mat, in the connection region thereof. Multi-ply or multiple layer constructions have also been proven successful, whereby the shape can be adapted in the fastening region to that of the frame. According to a preferred embodiment, the stainless steel mat is there constructed tubular-shaped, and is provided with special suspension brackets. All edges of the seating surface are flanged or beaded, preferably subject to insertion of a flat spring steel, in order to provide a burr-free termination without sharp edges flush with the seating plane.

Structurally there is proposed in an expedient embodiment according to the present invention to make the frame rectangular and of steel tubing, both longitudinal sides of which support the seating surface, whereby the transverse tubes are bent downwardly out of the seating plane. The bending-off additionally can be directed inwardly in order to increase the knee-bending freedom. Especially, it is also possible with this construction to prefabricate the frame out of a total of four parts, and thereby to provide plug connections with securing devices against turning or rotation at the individual parts. These, for example, can include a projection and a corresponding recess in the corresponding part, e.g. the frame. Furthermore, it is proposed to construct the back rest of the seating piece of furniture in an identical manner.

By means of the described construction of the tubular frame, the elastic or resilient deformability of the frame can be adjusted very well from a characteristic curve standpoint, the seating piece of furniture can be assembled in a simple manner subject to fastening of the seating surface, especially the stainless steel mat, and it is possible, with a few prefabricated parts, to provide, according to requirement, the embodiment as a stool, bench, or chair with or without a back rest. Furthermore, the rear transverse tube can be constructed softer than the front transverse tube, which absorbs more load, in order to further improve the seating comfort.

The seating piece of furniture according to the present invention is entirely non-combustible, has a pleasant feel to it while being aesthetically transparent and lightweight, and is hygienic because of the materials and the possibility of cleaning it, whereby the seating piece of furniture can be used inside as well as outside, thus for example as a hospital chair or a garden chair.

Referring now to the drawings in detail, the chain comprises a frame 1 for a stainless steel or high-quality steel woven mat 2 as a seating surface; a corresponding backrest frame 3 for a stainless steel woven mat 4 as a backrest; two tubular supports 5, 6 are fastened to the frame 1 as legs; and two tubular supports 7, 8 are provided for the backrest. All parts are made of steel.

The frames 1 and 3, which are essentially identical, as well as the stainless steel mats 2 and 4 fastened thereon, are essential and are described in detail in the following paragraphs with reference being made to the embodiment of the frame 1 illustrated in FIG. 2 of the drawings.

Accordingly, the frame 1 includes a front transverse piece 9, two longitudinal tubes 10, 11, and a rear transverse piece 12, which, just like the front transverse piece 9, is provided with cylindrical plugs or inserts 13 which correspond to the inner free or open diameter of the longitudinal tubes. A plug connection of the four described parts with one another is consequently possible, whereby a securing against turning or rotating is attained in that a projection 14 is respectively provided on each insert 13; this projection 14 respectively cooperates with a corresponding holding groove 15 in the longitudinal tubes 10, 11. The parts are connected with each other in a press fit or force fit, so that a shifting in the longitudinal direction is also avoided.

The front transverse piece 9 and the rear transverse piece 12 are bent or curved downwardly as well as inwardly out of the seat plane provided by the planar extension of the stainless steel mat 2 in its normal condition, so that the frame is resiliently or elastically deformable about its central longitudinal center-of-gravity line. The arrows "pressure direction" illustrate that the frame, in connection with the stainless steel mat 2, is under a prestress which acts upon and thereby stresses or tensions the stainless steel mat 2 in the pressure direction.

The stainless steel mat 2 is woven of chrome-nickel steel wire having a thickness of 1 mm and a mesh size of 0.3 mm. The surface is smoothed and optically finished by galvanic polishing or burnishing, whereby furthermore a rolling operation of the chrome-nickel steel wire mesh or mat in its entirety is undertaken within the framework of the production in order to increase the strength and to improve the seating comfort. The mat 2 is flanged or beaded along its four edges in order to attain a burr-free termination without sharp edges. The fastening at the longitudinal tubes 10 and 11 results by welding. To increase the carrying capacity, the stainless steel mat 2 is reinforced in the fastening region with tubular suspension brackets, which are not recognizable in the drawing. Essential is that the mat 2, with the longitudinal tubes 10 and 11 securedly welded thereto, can only be pushed onto the inserts 13 when the front transverse piece 9 and the rear transverse piece 12 have been compressed. A stressing or pretensioning is attained thereby, since the transverse pieces which were resiliently or elastically deformed for assembly transmit a force in the pressure direction, i.e. outwardly, upon the mat 2, which is thereby stressed or tensioned.

The described tubular parts which form the frame need not necessarily be straight, but can also be bent or curved, as for instance S-shaped in the seat, arcuate-shaped in the back, with slight bends at the front, rear, upper, or lower locations. These side tubes also can be made of several parts.

If the chair illustrated in FIG. 1 of the drawings is loaded with a seated individual, a transfer of the force upon the resiliently or elastically deformable frame 1 occurs via the flexible stainless steel mat 2 as a seating surface. The loading is taken up mainly by the frame 1, and consequently does not lead to a permanent deformation of the thin stainless steel mat 2. The elastic deformation of the frame proceeds opposite to the arrows designated with "pressure direction" in FIG. 2. The original position, under tensioning of the mat 2, is assumed again after removal of the load. No permanent change of shape of the frame 1 or of the mat 2 occurs.

The back rest frame 3 is resiliently or elastically deformable in the same manner when a force is applied or effective upon the stainless steel mat 4 as a back rest. The spring characteristic, and as the case may be the damping characteristic, naturally is adapted to the smaller loading in comparision to that of the seating surface.

The present invention is, of course, in no way restricted to the specific disclosure of the specification and drawings, but also encompasses any modifications within the scope of the appended claims.

What I claim is:

1. A seating piece of furniture especially entirely of non-combustible material, which comprises in combination:

a frame including two frame longitudinal portions having outer edges arranged in parallel spacing to each other in a manner elastically deformable under load as well as including two transverse frame portions structurally elastically deformable and connected to said two longitudinal portions; and flexible seat fastened to the two frame longitudinal portions of said frame retaining said transverse frame portion in an elastically deformed position thereby holding said flexible seat permanently in a stressed spring back relationship therewith.

2. A seating piece of furniture in combination according to claim 1, in which said portions collectively determine elastic deformability of said frame set in a load-dependent manner in such a way that with increasing weight on said seat, a progressive stiffening of said frame is provided in the sense of an increase of the resistance to deformation.

3. A seating piece of furniture in combination according to claim 2, which includes at least one bending of portions as spring elements, damping elements, and stabilizers.

4. A seating piece of furniture in combination according to claim 1, in which said frame includes at least one assembled steel tube, including two oppositely located longitudinal tube segments; and in which said seat is a stainless steel woven mat which is tensioned between said two longitudinal tube segments.

5. A seating piece of furniture in combination according to claim 4, in which said steel tubes are chrome plated.

6. A seating piece of furniture in combination according to claim 4, in which said stainless steel woven mat is subjected to at least one of a polishing and rolling process.

7. A seating piece of furniture in combination according to claim 4, in which said stainless steel woven mat comprises woven chrome-nickel steel wire having a thickness of between 0.20 and 1.25 mm, and has a mesh size of 5 to 0.5 mm.

8. A seating piece of furniture in combination according to claim 4, in which the connection of said seat to portion of said frame is accompanied by the application of a seat prestressing.

9. A seating piece of furniture in combination according to claim 8, in which said stainless steel mat is reinforced in the region of its connection to said frame.

10. A seating piece of furniture in combination according to claim 4, in which the edges of said stainless steel mat are flanged.

11. A seating piece of furniture in combination according to claim 4, in which said frame is rectangular and comprises steel tubing, including two longitudinal sides which support said seat, and two transverse sides which are bent downwardly out of the plane of said seat.

12. A seating piece of furniture in combination according to claim 11, in which said transverse sides are also bent inwardly.

13. A seating piece of furniture in combination according to claim 12, in which said frame comprises four parts which are provided with insert connections having means to protect against rotation of said parts.

14. A seating piece of furniture in combination according to claim 13, in which some of said parts are provided with an insert, and other of said parts are provided with a corresponding receiving opening; and in which said means to protect against rotation includes a projection on said insert, and a corresponding recess in said other part.

15. A seating piece of furniture in combination according to claim 1, which includes a back rest which comprises a frame and mat which are identical to said frame and seat.

* * * * *